United States Patent [19]

Robin

[11] 4,311,189

[45] Jan. 19, 1982

[54] HEAT EXCHANGER

[75] Inventor: Marcel Robin, Sevres, France

[73] Assignee: Commissariat a l'Energie Atomique, Paris, France

[21] Appl. No.: 118,929

[22] Filed: Feb. 6, 1980

[30] Foreign Application Priority Data

Feb. 14, 1979 [FR] France ..... 79 03746

[51] Int. Cl.[3] ..... F28F 11/00

[52] U.S. Cl. ..... 165/11 R; 165/72; 165/81; 165/157; 122/32; 376/249

[58] Field of Search ..... 165/110, 72 X, 75, 157, 165/163, 81, 71, 145; 176/19 R; 122/32

[56] References Cited

U.S. PATENT DOCUMENTS

| | | | |
|---|---|---|---|
| 2,110,024 | 3/1938 | Miller | 165/75 |
| 3,112,735 | 12/1963 | Schlichting et al. | 122/32 |
| 3,319,657 | 5/1967 | Nyiri | 138/27 |
| 3,941,187 | 3/1976 | Jabsen et al. | 165/157 |
| 4,216,821 | 8/1980 | Robin | 165/11 |

FOREIGN PATENT DOCUMENTS

| | | |
|---|---|---|
| 2536757 | 3/1976 | Fed. Rep. of Germany . |
| 1352958 | 1/1964 | France . |
| 2112007 | 6/1972 | France . |
| 2149983 | 3/1973 | France . |
| 2379881 | 9/1978 | France . |

*Primary Examiner*—Albert W. Davis
*Assistant Examiner*—Margaret A. Focarino
*Attorney, Agent, or Firm*—Lane, Aitken, Kice & Kananen

[57] ABSTRACT

Exchanger which incorporates a casing in which the heat carried by a primary fluid is transferred to a secondary fluid so as to heat the latter, the secondary fluid circulating in the tubes, whose opposite ends issue into tubular supply and discharge mains located externally of the exchanger casing and surrounding the latter at least partly, wherein each of the tubes comprises two access devices each sealed by a removable plug, while each of the access devices is located in a part of the tube positioned between the exchanger casing and the corresponding main.

The present exchanger is intended more particularly for the transfer of heat between two circuits of a nuclear power station.

11 Claims, 8 Drawing Figures

HEAT EXCHANGER

BACKGROUND OF THE INVENTION

The invention relates to an exchanger for the transfer of heat between two circuits of a nuclear power station.

The invention more particularly relates to an exchanger, such as a steam generator or boiler having a casing in which the heat carried by a primary fluid is transferred to a secondary fluid in such a way as to heat and possibly vaporize the latter, the secondary fluid circulating in tubes, whose opposite ends issue into supply and discharge mains arranged externally of the steam generator casing. Steam generators of this type are used in particular, although not exclusively in the circuits of liquid metal-cooled nuclear reactors for ensuring a heat transfer between a cooling ciruit in which travels a liquid metal such as sodium and a circuit which supplies an electricity generation installation in which flows a liquid such as water.

In steam generator of this type, the length of the tubes in which the secondary fluid flows, said fluid generally being water, is adapted to the quality of the steam to be produced and is often approximately 100 meters. There is a relatively large number of these tubes in order to permit the maximum heat exchange between the liquid sodium which generally forms the primary fluid and the water or steam circulating in the tubes, the latter immersed in liquid sodium. For obvious safety reasons, it is vital to be able to check the sealing of the tubes. It is also necessary to be able to carry out certain measurements and in particular the measurement of the steam temperature on leaving the tubes, as well as certain checks during periods when the generator is shut down, such as the individual inspection of each of the tubes, for example by means of an ultrasonic or eddy current probe.

Steam generators are known in which the tubes issue at each of their ends into a water box and a steam box, which are substantially cylindrical, whereby for example there are four supply boxes and four discharge boxes whilst the generator has approximately 360 tubes, in such a way that approximately 90 tubes issue into each of the boxes. Mains collect together the outlets of the water and steam boxes. In order to permit the checks and measurements referred to hereinbefore, the tubes issue into one of the ends of each of the boxes via a removable cover, whose removal gives access to the orifice of each of the tubes issuing into the said box. Due to the number of tubes issuing into each of the boxes, the dimensions of the latter are relatively large in such a way that they must incrorporate tube plates and thick walls, whilst the cover diameter is relatively large. As a result, there can be sealing defects during operation between each box and its cover, which is conventionally in the form of an autoclave joint, whose diameter can reach approximately 420 mm. Moreover, as a result of the box dimensions, whose length is considerable compared with its diameter it is relatively difficult to mark the tubes and obtain access to a clearly defined orifice. Finally, the exchanger and mains are generally positioned within thermal insulation, which must be removed before access to the tubes can be obtained.

BRIEF SUMMARY OF THE INVENTION

The object of the invention is an exchanger making it possible to obviate the disadvantages referred to hereinbefore by eliminating the thick tube plates and the large diameter gaskets, whilst facilitating access to the orifices of each of the tubes in order to check the state of the wall of the tubes, together with their sealing and carry out the measurements necessary or check the state of a flow stabilisation device (diaphragm).

To this end, an exchanger is provided which incorporates a casing in which the heat carried by a primary fluid is transferred to a secondary fluid so as to heat the latter, the secondary fluid circulating in the tubes, whose opposite ends issue into tubular supply and discharge mains located externally of the exchanger casing and surrounding the latter at least partly, wherein each of the tubes comprises two access devices each sealed by a removable plug, whilst each of the access devices is located in a part of the tube positioned between the exchanger casing and the corresponding main.

The use of per se known tubular mains makes it possible to substantially reduce the thickness of the walls compared with cylindrical boxes, due to the reduction of the resulting stresses level with the walls for a given internal pressure. Moreover, the provision at each end of the tubes, between the main and the casing of the exchanger, of an access device sealed by a removable plug makes it possible to obviate the sealing problems linked with the large dimensions of the orifice to be sealed, whilst facilitating individual access of each of the tubes, particularly by arranging the access devices outside the thermal insulation, when the exchanger casing and the mains are located within a thermal insulation.

According to a preferred embodiment of the invention, each of the said tube parts has a first linear portion terminated by the access device and a second portion forming a T with the linear portion and connecting the latter to the corresponding main.

Preferably, the linear portion of each of the said tube parts then extends in a direction which is substantially perpendicular to the exchanger casing.

In the same way, the second portion of each of the tube parts is preferably connected to the linear portion in the vicinity of the corresponding access device. The plug sealing the access device located in that part of each of the tubes located between the exchanger casing and the supply main can then carry a tubular member which extends into the linear portion of the part of the tubes beyond the connection of the second portion of said part of the tubes, the tubular member then being laterally perforated level with the second portion and supports a diaphragm or more generally a device which creates an identical pressure drop beyond the latter.

According to a secondary feature of the invention the second portion of each of the said parts of the tubes forms an expansion bend. This feature makes it possible to limit in an advantageous manner the reaction exerted by each of the tubes on the thermal sleeve connecting the latter to the exchanger casing during variations in the temperature of the fluid circulating in the tubes.

According to another secondary feature of the invention, the linear portion of each of the said tube parts is surrounded by an anti-torsion device, whose one end is fixed to the exchanger casing and whose other end has for example at least one longitudinal recess which is penetrated by a finger integral with the linear portion in the vicinity of the access device, the anti-torsion device also having a longitudinal slot which traverses the second portion of the corresponding tube parts.

This feature makes it possible to oppose the torsion of the linear portion, particularly during the installation or removal of the plug sealing the access device.

According to a special embodiment of the invention each of the said tube parts has a threaded portion surrounding the access device onto which is screwed a nut by means of which the corresponding plug is normally sealingly drawn against the access device.

According to another feature of the invention at least one of the plugs sealing the access devices carries a temperature measuring device and all can be replaced by a sealing control device.

BRIEF DESCRIPTION OF THE DRAWINGS

The invention is described in greater detail hereinafter relative to a non-limitative embodiment and with reference to the attached drawings, wherein show.

DETAILED DESCRIPTION OF THE PREFERRED EMBODIMENTS

Figure 1:
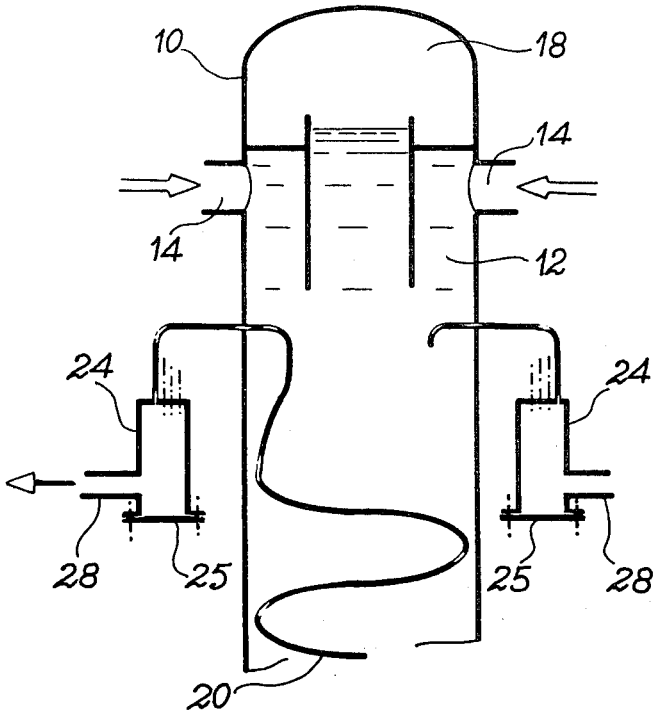
FIG. 1 PRIOR ART
FIG. 1 a diagrammatic sectional view of a prior art steam generator or boiler.
Figure 1:
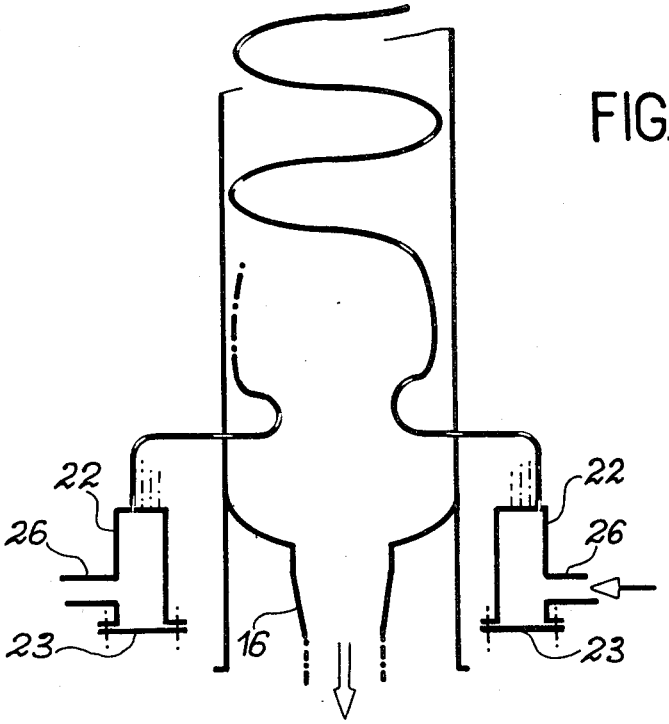
FIG. 1 PRIOR ART

The steam generator or boiler diagrammatically shown in FIG. 1 is known and can be disposed between a cooling circuit of a liquid metal-cooled nuclear reactor and a circuit supplying an electricity generation installation. A steam generator of this type incorporates a generally cylindrical casing 10, which is arranged in vertical manner and within which circulates the primary fluid 12, more particularly constituted by a liquid metal such as sodium, which penetrates the upper end of casing 10 via supply orifices 14 and which leaves the steam generator by an outlet orifice 16 formed at the bottom of casing 10.

Usually, sodium 12 circulates in a circuit of a nuclear reactor and conveys heat resulting from the reactions taking place in the reactor core.

Casing 10 is tightly sealed and the sodium 12 is placed under an argon atmosphere 18. A certain number of tubes 20, having an appropriate cross-section are arranged in accordance with a helix within the casing 10, where they are immersed in sodium 12, so that they transfer the greatest possible thermal power compatible with the satisfactory behaviour of the tubes to a volatile secondary fluid, such as water circulating in tubes 20. Due to the volatile nature of the secondary fluid circulating in tubes 20, the length and cross-section thereof are chosen in such a way that the fluid penetrating by the lower end thereof in the liquid state leaves at their upper end in the superheated steam state under the action of the heat given off by the liquid sodium 12. In the steam generator shown in FIG. 1, the lower and upper ends of tubes 20 are respectively connected to the four supply water boxes 22 and four discharge steam boxes 24, whereby two of each of these boxes only are shown in FIG. 1. The supply boxes 22 and discharge boxes 24 are substantially identical and each has a cylindrical wall with a vertical axis made in one piece with an upper terminal wall into which issue the corresponding ends of tubes 20 and their end is sealed by a removable cover 23, 25, giving access to the orifices of the facing tubes, notably in order to permit the inspection of the latter. Moreover, at least one supply pipe 26 and at least one discharge pipe 28 issue into the tubular wall of each of the boxes 22 and 24. Pipes 26 and 28 make it possible to connect each of the boxes to the water and steam mains respectively, each linear main receiving the outlet of two boxes. The mains are themselves connected to the electricity generation installation.

In the known steam generator described hereinbefore, the plates forming the walls of the boxes must be relatively thick in order to resist the pressure of the secondary fluid and the sealing between the removable cover and the box is provided by an autoclave joint with a relatively large diameter, which can for example reach 420 mm in such a way that sealing faults can occur during operation.

Figure 2:
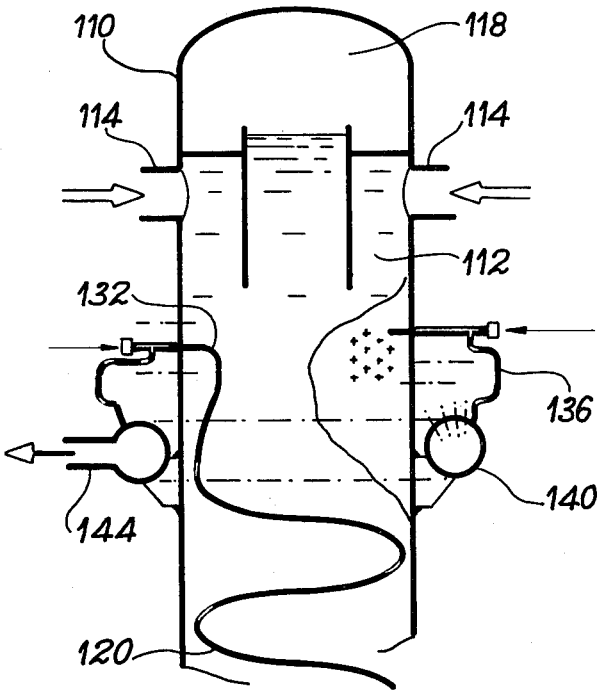
FIG. 2 a diagrammatic sectional view similar to FIG. 1 showing a steam generator or boiler constructed according to the present invention.
Figure 2:
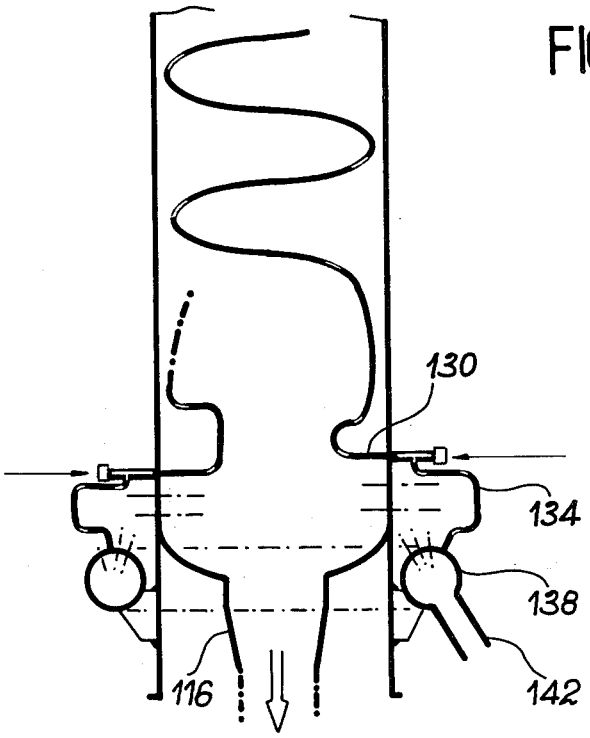

In order to obviate these disadvantages, the invention proposes, with reference to FIG. 2, a steam generator of substantially the same type as that shown in FIG. 1 and having a substantially cylindrical sealed casing with a vertical axis, supply and discharge orifices 114, 116 respectively for the primary fluid 112 formed respectively in the upper part and in the base of casing 110, the primary fluid 112 being under an argon atmosphere 118, whilst the secondary fluid circulates in tubes 120 positioned for example in helical manner within the casing 110 in such a way that the secondary fluid circulates between the lower end 130 and the upper end 132 of tubes 120. The lower and upper ends 130, 132 respectively of tubes 120 issue into the annular parts of the cylindrical wall of casing 110 and extend externally of the latter by portions 134, 136, whose ends issue respectively into a tubular supply main 138 and a tubular discharge main 140 surrounding at least partly the casing 110 of the steam generator. As shown in FIG. 2, the mains 138 and 140 are positioned below the ends 130 and 132 of tubes 120, in such a way that portions 134, 136 disposed externally of casing 110 issue into the upper part of mains 138, 140. The supply main 138 is supplied with secondary liquid, such as water by at least supply pipe 142, for example by means of a pump (not shown) and the discharge main 140 supplies steam by at least one discharge pipe 144 to one or more known devices (not shown) permitting the conversion of the energy stored in the steam into industrially usable energy and in particular into electric power. Thus, the tubes 120 constitute part of a sealed circuit, in general the supply circuit of the electricity generator installation in a liquid metal-cooled nuclear reactor and in which circulates the secondary volatile liquid such as water.

The tubular shape of mains 138, 140 makes it possible to significantly reduce the thickness of the walls forming the same, due to the reduction in the stresses produced in the wall by a given internal pressure compared with the box-like mains formed by a planar plate into which issue the tubes and a cover. As an example, the internal diameter of each of the tubular mains can be approximately 400 mm.

Figure 6:
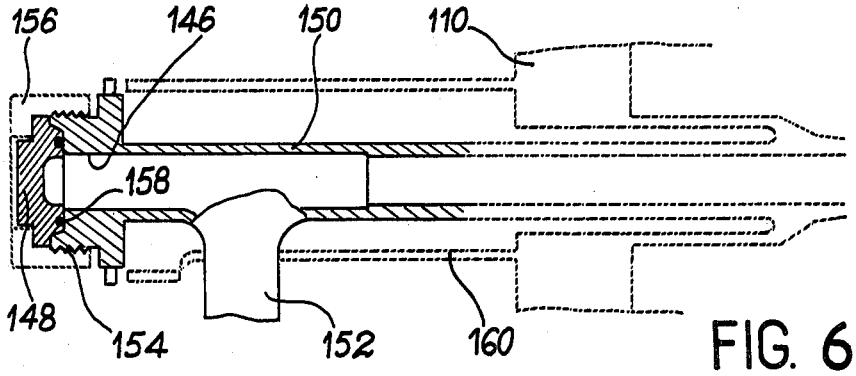
FIG. 6 the linear portion formed at one end of one of the generator tubes shown in FIG. 2 outside the generator casing, illustrating in particular the sealing of the access device by a removable plug.

According to the invention and as shown in FIG. 6 the access to the ends 130, 132 of each of the tubes 120 is brought about by access devices 146 having orifices formed in each of the parts 134, 136 and normally sealed by removable plugs 148. It is thus possible to have access individually to the two ends of each of the tubes 120 without it being necessary to provide the mains 138, 140 with a large cover, whose sealing may become defective during the operation of the reactor. Casing 110 and mains 138, 140 are generally positioned within a thermal insulation 149 (FIG. 2) and the access devices 146 then project externally of this thermal insulation.

Mains 138, 140, as well as the outer parts 134, 136 of tubes 120 are symmetrical in such a way that only the supply main 138 and one of the corresponding outer parts 134 of tubes 120 will be described with reference to FIG. 3, before describing an example of the distribution in space of said tube parts with reference to FIGS. 4 and 5.

Each of the part 134 has a linear portion 150, which extends in a direction which is substantially perpendicular to the steam generator casing 110 and a substantially vertical portion 152 forming a T with the linear portion 150 for connecting the latter to main 138. As shown in FIG. 3, the linear portion 150 of outer part 134 of tube 120 is terminated by an access device 146, normally sealed by the plug 148, as is in particular illustrated by FIG. 6.

The vertical portion 152 of outer part 134 is connected to the linear portion 150 in the vicinity of access device 146 in such a way that the various control, measuring and other devices can be introduced into the external part 134 level with the connection between portions 150 and 152 of each of the outer parts of the tubes, as will be shown hereinafter.

In order not to modify the flow of the secondary liquid, the internal cross-section of tubes 120 is preferably constant, even level with the outer parts 134, 136.

As is shown in particular in FIG. 6, each of the tubes has at the end of its linear portion 150 surrounding the access device 146 a threaded part 154 onto which is threaded a nut 156 by means of which the corresponding plug 148 or any control or measuring device is brought against the annular end of the linear portion 150 of the tube, in such a way that an annular joint 158 carried by plug 148 sealingly engages the said end. In order to prevent, particularly during the tightening of nut 156, torsion of the linear portion 150 of the tubes, said portion 150 is provided with an anti-torsion device 160 (cf FIG. 3) comprising a tube, whose one end is fixed to the generator casing 110 by any appropriate means such as, for example, a weld 162 and whose other end has two diametrically opposite recesses 164 which extend in a longitudinal direction with respect to tube 160 and into which pentrate fingers 166 extending radially outwardly from the end of the linear portion 150 in which is formed the access orifice 146. Obviously, there can be a different number of recesses 164 and fingers 166 and the latter can also be joined to the linear portion 150 of the pipe. The anti-torsion tube 160 also has a longitudinal slot 168 in its lower part and this slot traverses the vertical portion 152 of tube 120. Any torsion of the linear portion 150 of each of the tubes 120 particularly when the corresponding nut 156 is screwed or unscrewed is thus prevented both level with the access orifice 146 by the cooperation of fingers 166 with recesses 164 and level with the vertical portion 152 of tube 120 due to the engagement of said portion 152 with the edges of slot 168.

Figure 3:
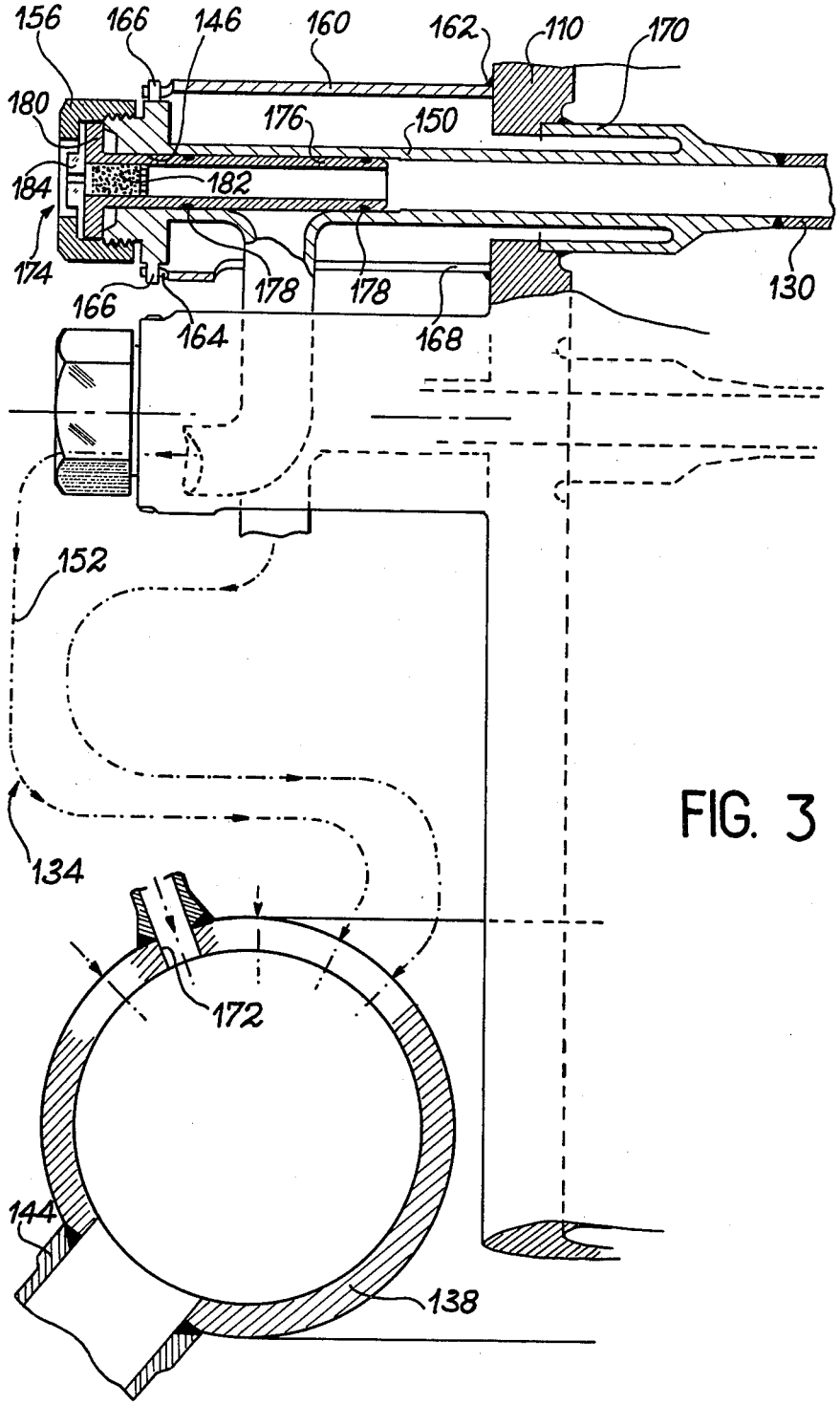
FIG. 3 a larger scale view and partly in section of a detail of the steam generator shown in FIG. 2 representing one end of one of the tubes in which circulates the secondary fluid and in particular that part positioned externally of the generator casing and issuing into a toroidal main, illustrating in particular the fitting of a leak detection device into the access device formed in the tube.

As is also illustrated in FIG. 3, the linear portion 150 of each of the outer parts 134, 136 of tubes 120 traverses the steam generator casing 110 with a certain clearance and it is fixed to the latter by a thermal sleeve 170 arranged within the casing and fixed to the latter by any appropriate means such as, for example, a weld. This structure makes it possible to compensate the deformations resulting from the expansion of the tubes and the steam generator casing.

Figure 4:
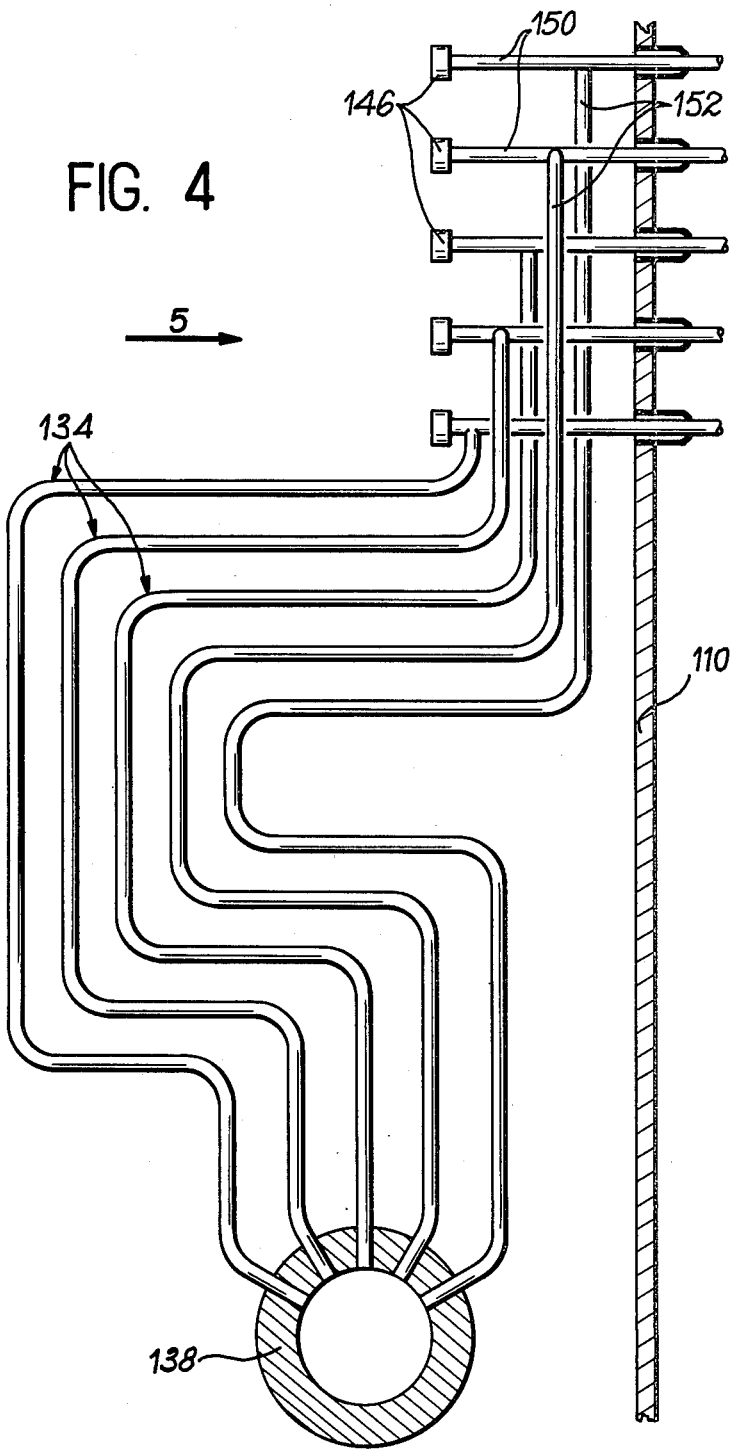
FIG. 4 a view comparable to FIG. 3 showing the arrangement of the tube parts located between the generator casing and one of the mains.

According to a secondary feature of the invention and in order to eliminate the expansion effects of the outer parts 134 and 136 of tubes 120 on the thermal sleeves 170 by means of which the tubes are fixed to the casing 110, each of the vertical portions 152 is in the form of an expansion bend, as is shown by the mixed lines in FIG. 3 and as shown in a more specific manner in FIG. 4. Each of the branched portions 152 is fixed to the wall of the corresponding main by any appropriate means which has, for example, a weld and communicates with the inside of the main by a radial opening 172 formed in the wall of the latter.

Figure 5:
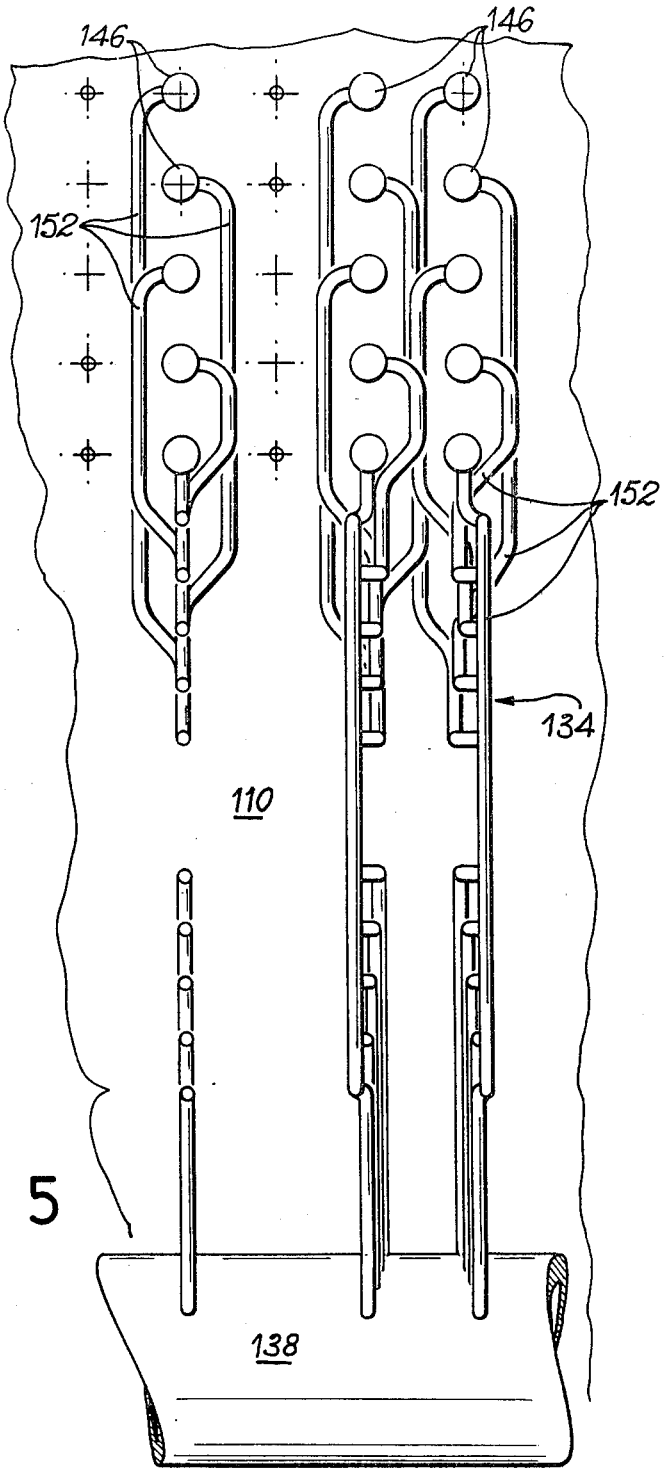
FIG. 5 a view according to the arrow 5 of FIG. 4.

As is more specifically shown in FIGS. 4 and 5 the distribution in space of the outer parts 134 of tubes 120 requires special care due to the large number of tubes passing outside the exchanger casing 110 and the special shape of the outer parts 134 imposed by the invention. Thus, in the represented embodiment, the tubes 120 traverse casing 110 in a certain number of superimposed layers (five in the drawings) and form rows regularly distributed over the casing circumference each row being constituted by one tube of each layer and the tubes of each row being alinged in accordance with a generating line of the casing.

The linear portions 150 of each of the tubes project radially outwardly of exchanger casing 110 in such a way that they are distributed in the form of five superimposed layers defining rows of five linear portions regularly distributed over the casing periphery. Portions 152 pass out laterally over portions 150, as shown in FIG. 5, so as to be able to descend vertically between the rows formed by the tubes. The opening of portion 156 into portion 150 being moved further away from casing 110 in the same proportion as portion 150 is positioned in a layer closer to main 138 (cf FIG. 4).

In the represented embodiment, portions 152 corresponding to one and the same row of tubes issue alternately to one side and then the other side of portions 150 (cf FIG. 5) in such a way that portions 152 corresponding to two adjacent rows are staggered in their vertical portions disposed between these rows. According to a not shown variant, portions 152 can issue to the same side of the corresponding row of portions 150 and the vertical parts of portions 152 located between two adjacent rows then correspond to one and the same row of tubes.

In both cases, portions 152 corresponding to the same row of tubes are brought into the radial plane passing through the linear portions 150 of said row of tubes in order to form there incorporated expansion bends (FIG. 4). The portions 152 of each row of tubes are then connected to main 138 in equidistant manner over a sector defined in the upper part of the main in the same radial plane as the corresponding portions 150.

Due to the arrangement of the access orifices 146 at the end of the linear portion 150 of each of the outer parts of tubes 120 and due to the special shape of the vertical portions 152, the access of each of the orifices is particularly easy, as is particularly shown in FIGS. 3 and 4. It is thus possible to use the access orifice formed in each of the linear portions 150 to carry out, during a stoppage, an inspection of the tubes by eddy currents or a control of the sealing. Moreover, it is possible to install through said orifice regulating, measuring or control devices with respect to the operation of the generator, as will be explained hereinafter in connection with the description of FIGS. 7 and 8.

Thus, FIG. 3 illustrates the replacement of one of the plugs 148 by a device for checking the sealing of the corresponding tube 120, designated by the general reference numeral 174. This device is fitted after cooling the steam generator and draining the secondary circuits. It essentially comprises a tubular end fitting 176 extending beyond the T-shaped connection of portion 152 for sealing the latter by means of annular joints 172 positioned on either side of the opening of the vertical portion. The tubular end fitting 176 has a flange 180 locked by means of nut 156 against the free end of linear portion 150 of the tube in which is located a porous member, such as a sponge 182 filled for example with soapy water. The steam generator casing 110 is maintained under a limited argon pressure, so that device 174 thus makes it possible to observe the bubbles which form in the soapy water impregnating the sponge 182 on leaving the tubular opening 176 in the case of a leak in the corresponding wall of tube 120. This leak detection device is only described as a non-limitative embodiment and can be replaced by any other known device. For example, in the case of a micro-leak requiring the use of a more sensitive method the described device can be used differently by impregnating sponge 182 with a reagent sensitive to a given gas injected into the argon within the steam generator casing 110, whereby said gas can for example be ammonia. The colouring of the reagent is then observed through a transparent plate 184 partly sealing the end of device 174. Another means for checking the sealing of the tubes using the inspection orifices 146 made at the ends of each of the tubes 120 consists of injecting helium into the generator casing 110, sealing one of the ends of the tube by means of plug 140 and connecting a known helium detector to the other end.

Figure 7:
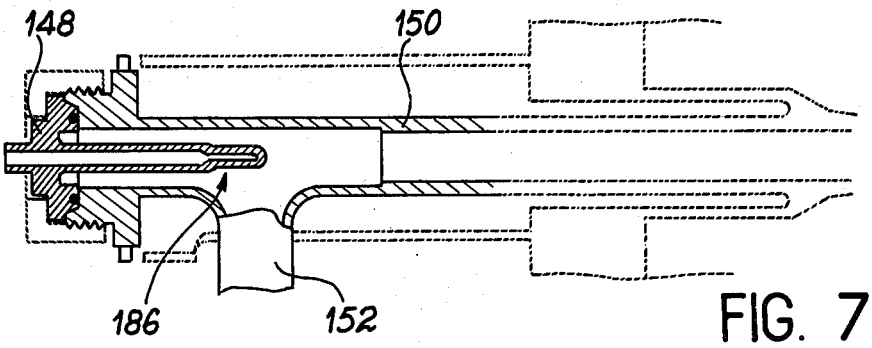
FIG. 7 a view similar to FIG. 6 in which the plug sealing the access device carries a temperature measuring device.

FIG. 7 represents the hypothesis in which the plug 148 of one of the tubes 134, 136 carries a glove support 186 able to receive a temperature measuring device such as a thermocouple connected to an appropriate measuring device and whose sensitive part is preferably located level with the connection of the vertical portion 152 to the linear portion 150. The thermocouple which can be received in the glove finger support 186 carried by plug 148 can in particular make it possible to measure the temperature of the superheated steam leaving from a certain number of appropriately chosen tubes 120.

Figure 8:
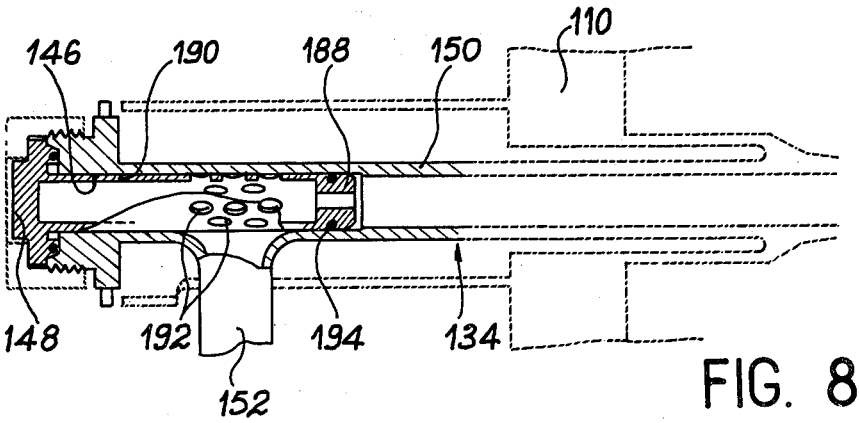
FIG. 8 a view similar to FIGS. 6 and 7 in which the removable plug sealing the access device supports a diaphragm for stabilising the secondary liquid flow penetrating the tube corresponding to the generator, said latter case corresponding to the supply main of the secondary liquid in the apparatus.

Finally, FIG. 8 shows the linear portion 150 of the outer part 134 of a tube 120, whose end issues into the supply main 138, the plug 148 sealing the access orifice 146 formed in portion 150 carrying a diaphragm 188, making it possible to stabilise the flow of water circulating in the tubes 120 of the steam generator. Diaphragm 188 is formed at the end of a tubular member 190 carried by plug 148 and extending beyond the junction between the vertical portion 152 and the linear portion 150 of part 134. The tubular member 190 is laterally perforated by means of holes 192 formed level with the vertical portion 152 and an annular gasket 194 is positioned between tubular member 190 and the linear portion 150 of the tube between the branched portion 152 and the steam generator casing 110 in such a way that the water coming from the supply main 138 and entering linear portion 150 through portion 152 must pass through holes 192 and diaphragm 188 before entering the steam generator. The control and the possible replacement of diaphragms 188 can be carried out in a particularly simple manner. Obviously, diaphragm 188 can be replaced by any device which creates an identical pressure drop.

Obviously, the measuring and control devices described hereinbefore in exemplified manner are in no way limitative of the access possiblities to the ends of the steam generator tubes resulting from the present invention. In particular, the removal of each of the plugs 148 can permit, after cooling and draining the generator, the introduction of any known measuring or control devices, such as e.g. an ultrasonic or eddy current probe permitting the inspection of each of the tubes. Moreover, the invention is not limited to a steam generator and relates to all exchangers in which the heat carried by a primary fluid is used for heating a secondary fluid.

What is claimed is:

1. An exchanger which incorporates a casing in which the heat carried by a primary fluid is transferred to a secondary fluid so as to heat the latter, the secondary fluid circulating in tubes whose opposite ends issue into tubular supply and discharge mains located externally of the exchanger casing and surrounding the latter at least partly, wherein each of the tubes comprises two access devices each sealed by a removable plug, whilst each of the access devices is located in a part of the tube positioned between the exchanger casing and the corresponding main.

2. An exchanger according to claim 1, wherein each of the parts of the tubes has a first linear portion terminated by the access device and a second portion forming a T with the linear portion and connecting the latter to the corresponding main.

3. An exchanger according to claim 2, wherein the linear portion of each of the tube parts extends in a direction which is substantially perpendicular to the exchanger casing.

4. An exchanger according to claim 2, wherein the second portion of each of the said tube parts is connected to the linear portion in the vicinity of the corresponding access device.

5. An exchanger according to claim 4, wherein the plugs sealing the access device located in the part of each of the tubes located between the exchanger casing and the supply main carries a tubular member extending into the linear portion of that part of the tubes beyond the connection of the second portion of said part of the tubes, the tubular member being laterally perforated level with the second portion and supports a diaphragm or a device which creates an identical pressure drop beyond the latter.

6. An exchanger according to claim 2, wherein the second portion of each of the said tube parts forms an expansion bend.

7. An exchanger according to claim 2, wherein the linear portion of each of the said tube parts is surrounded by an anti-torsion device, whose one end is fixed to the exchanger casing and whose other end has for example at least one longitudinal recess which is penetrated by a finger integral with the linear portion in the vicinity of the access device, the anti-torsion device also having a longitudinal slot which traverses the second portion of the corresponding tube parts.

8. An exchanger according to claim 1, wherein each of the said parts of the tubes comprises a threaded portion surrounding the access device, onto which is screwed a nut by means of which the corresponding plug is normally sealingly brought against the access device.

9. An exchanger according to claim 1, wherein at least one of the plugs sealing the access devices carries a temperature measuring device.

10. An exchanger according to claim 1, wherein at least one the plugs sealing the access devices carries a sealing control device.

11. An exchanger according to claim 1, wherein the exchanger casing and the mains are enveloped at least partly in a thermal insulation and the access devices are positioned outside the said thermal insulation.

* * * * *